US008133334B2

(12) United States Patent
Mannan et al.

(10) Patent No.: US 8,133,334 B2
(45) Date of Patent: Mar. 13, 2012

(54) PROCESS FOR MANUFACTURING HIGH STRENGTH CORROSION RESISTANT ALLOY FOR OIL PATCH APPLICATIONS

(75) Inventors: Sarwan K. Mannan, Barboursville, WV (US); Brett Clark Puckett, Proctorville, OH (US)

(73) Assignee: Huntington Alloys Corporation, Huntington, WV (US)

( * ) Notice: Subject to any disclaimer, the term of this patent is extended or adjusted under 35 U.S.C. 154(b) by 244 days.

(21) Appl. No.: 12/176,431

(22) Filed: Jul. 21, 2008

(65) Prior Publication Data

US 2009/0038717 A1 Feb. 12, 2009

Related U.S. Application Data

(62) Division of application No. 11/268,069, filed on Nov. 7, 2005, now Pat. No. 7,416,618.

(51) Int. Cl.
*C22F 1/10* (2006.01)

(52) U.S. Cl. ..... 148/675; 148/677

(58) Field of Classification Search ..... 148/675, 148/677

See application file for complete search history.

(56) References Cited

U.S. PATENT DOCUMENTS

| | | | | |
|---|---|---|---|---|
| 3,015,558 | A * | 1/1962 | Grant et al. | 420/445 |
| 3,519,419 | A * | 7/1970 | Gibson et al. | 420/448 |
| 4,358,511 | A | 11/1982 | Smith, Jr. et al. | |
| 4,750,950 | A | 6/1988 | Clatworthy et al. | |
| 4,908,069 | A | 3/1990 | Doherty et al. | |
| 4,979,995 | A | 12/1990 | Hattori et al. | |
| 5,000,914 | A | 3/1991 | Igarashi et al. | |
| 5,945,067 | A | 8/1999 | Hibner et al. | |
| 6,004,408 | A | 12/1999 | Montagnon | |
| 6,315,846 | B1 * | 11/2001 | Hibner et al. | 148/675 |
| 6,623,869 | B1 | 9/2003 | Nishiyama et al. | |

FOREIGN PATENT DOCUMENTS

| | | | |
|---|---|---|---|
| CN | 1258756 | A | 7/2000 |
| EP | 0052941 | A1 | 6/1982 |
| EP | 0056480 | A2 | 7/1982 |
| EP | 0268241 | A2 | 5/1988 |

OTHER PUBLICATIONS

Cayard, M.S. et al., "Serviceability of 13Cr Tubulars in Oil and Gas Production Environments", Corrosion 98, Paper No. 112, NACE, Houston, TX (1998).

Hibner, Edward L. et al., "Comkparison of Corrosion Resistance of Nickel-Base Alloys for OCTG's and Mechanical Tubing in Severe Sour Service Conditions", Corrosion 2004, Paper No. 04110, NACE, Houston, TX (2004).

* cited by examiner

*Primary Examiner* — Sikyin Ip
(74) *Attorney, Agent, or Firm* — The Webb Law Firm

(57) ABSTRACT

A Ni—Fe—Cr alloy having high strength, ductility and corrosion resistance especially for use in deep-drilled, corrosive oil and gas well environments, as well as for marine environments. The alloy comprises in weight %: 35-55% Ni, 12-25% Cr, 0.5-5% Mo, up to 3% Cu, 2.1-4.5% Nb, 0.5-3% Ti, up to 0.7% Al, 0.005-0.04% C, balance Fe plus incidental impurities and deoxidizers. The alloy must also satisfy the ratio of (Nb−7.75 C)/(Al+Ti)=0.5-9 in order to obtain the desired high strength by the formation of γ' and γ" phases. The alloy has a minimum of 1% by weight γ" phase dispersed in its matrix for strength purposes and a total weight percent of γ'+γ" phases being between 10 and 30.

6 Claims, 2 Drawing Sheets

Selected area diffraction pattern of Alloy #7 (heat treatment C) obtained using transmission electron microscopy (TEM) instrument, showing matrix, γ' and γ" diffracted spots. The streaks are generated by the presence of γ".

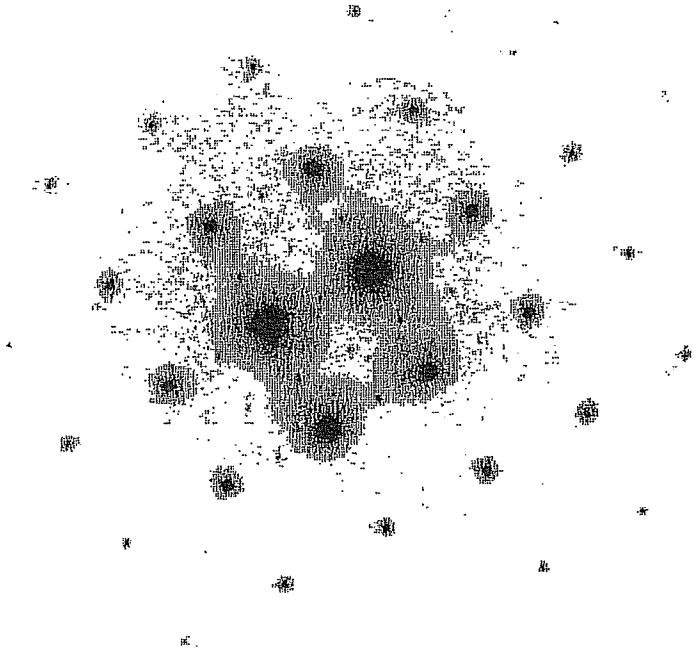
FIG. 1. Selected area diffraction pattern of Alloy #1 (heat treatment B) obtained using transmission electron microscopy (TEM) instrument, showing matrix and γ' diffracted spots.

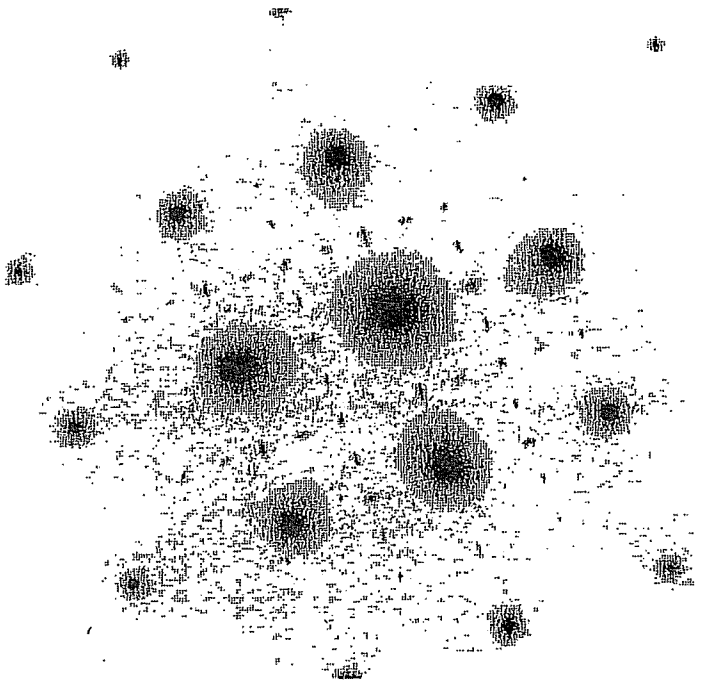
FIG. 2. Selected area diffraction pattern of Alloy #7 (heat treatment C) obtained using transmission electron microscopy (TEM) instrument, showing matrix, γ' and γ" diffracted spots. The streaks are generated by the presence of γ".

PROCESS FOR MANUFACTURING HIGH STRENGTH CORROSION RESISTANT ALLOY FOR OIL PATCH APPLICATIONS

CROSS-REFERENCE TO RELATED APPLICATION

This application is a division of U.S. patent application Ser. No. 11/268,069 filed Nov. 7, 2005, now U.S. Pat. No. 7,416,618 issued Aug. 26, 2008, which is incorporated by reference herein in its entirety.

BACKGROUND OF THE INVENTION

1. Field of the Invention

The present invention relates generally to corrosion resistant metal alloys and, more particularly, to nickel-iron-chromium alloys which are particularly useful in corrosive oil and gas well and marine environments where high strength, corrosion resistance and reasonable cost are desired attributes.

2. Description of Related Art

As the older shallow and less corrosive oil and gas wells deplete, higher strength and more corrosion resistant materials are needed to allow for deeper drilling which encounters more corrosive environments.

Oil patch applications now require alloys of increasing corrosion resistance and strength. These increasing demands arise from factors including: deep wells that involve higher temperatures and pressures; enhanced recovery methods such as steam or carbon dioxide ($CO_2$) injection; increased tube stresses especially offshore; and corrosive well constituents including: hydrogen sulfide ($H_2S$), $CO_2$ and chlorides.

Materials selection is especially critical for sour gas wells—those containing $H_2S$. Sour well environments are highly toxic and extremely corrosive to traditional carbon steel oil and gas alloys. In some sour environments, corrosion can be controlled by using inhibitors along with carbon steel tubulars. The inhibitors, however, involve continuing high cost and are often unreliable at high temperatures. Adding corrosion allowance to the tubing wall increases weight and reduces interior tube dimensions. In many cases, the preferred alternative in terms of life-cycle economy and safety is the use of a corrosion resistant alloy for tubulars and other well components. These corrosion resistant alloys eliminate inhibitors, lower weight, improve safety, eliminate or minimize workovers and reduce downtime.

Martensitic stainless steels, such as the 13% chromium alloys satisfy corrosion resistance and strength requirements in slightly corrosive oil patch applications. The 13% alloys, however, lack the moderate corrosion resistance and strength required of low-level sour gas wells. Cayard et al., in "Serviceability of 13Cr Tubulars in Oil and Gas Production Environments," published sulfide stress corrosion data that indicate 13Cr alloys have insufficient corrosion resistance for wells that operate in the transition region between sour gas and non-sour gas environments. Further background art may be found in U.S. Pat. No. 4,358,511 to Smith, Jr. et al. and U.S. Pat. No. 5,945,067 to Hibner et al.

While the mildly corrosive wells are handled by various 13Cr steels, Ni-base alloys are needed for the more highly corrosive environments. Among the more commonly used Ni-base alloys for oil patch use are austenite high-Ni-base alloys such as, for example, alloys 718, 725, 825, 925, G-3, C-276 which provide increased resistance to corrosive sour gas environments. These aforementioned alloys, however, are either too expensive or do not possess the necessary combination of high strength and corrosion resistance.

The present invention solves the problems encountered in the prior art by providing an alloy with excellent corrosion resistance to function in sour gas environments coupled with excellent mechanical properties for service in demanding deep well oil and gas applications. In addition, the present invention provides a high strength and corrosion resistant alloy for use in oil patch applications at a reasonable cost.

SUMMARY OF THE INVENTION

Briefly stated, the present invention is directed to a Ni—Fe—Cr alloy containing small amounts of Mo and Cu having controlled, correlated amounts of Nb, Ti, Al and C in order to develop a unique microstructure to provide a 120 ksi minimum yield strength. Broadly, the alloy has a ratio of (Nb−7.75 C)/(Al+Ti) in the range of 0.5 to 9. In the foregoing calculation, the 7.75×the weight percent carbon corrects for atomic weight differences between carbon (atomic weight 12.01) and that of Nb (atomic weight 92.91). In other words, the 7.75×weight percent C takes that much weight percent Nb out of the matrix and unavailable for forming precipitation hardening phases. When the ratio value of 0.5 to 9 is satisfied, the alloy will have a combination of γ" (gamma double prime) phase and γ' (gamma prime) phase as strengthening phases with a minimum of 1 wt. % γ" phase present and a weight percent range of γ'+γ" from 10 to 30 and preferably a weight percent range from 12-25 when the ratio is 0.5 to 8 and still more narrowly when the ratio is 0.5 to 6, as determined by ThermoCalc.

The unique microstructure is obtained by annealing and age hardening conditions which provide an attractive combination of impact strength, ductility and corrosion resistance to enable the material of the invention to be used in corrosive oil and gas well applications that contain gaseous mixtures of carbon dioxide ($CO_2$) and hydrogen sulfide ($H_2S$) typically found in sour well environments. The material of the invention is also useful in marine applications where strength, corrosion resistance and cost are important factors relating to material selection.

This specification describes all compositions in weight percent, unless specifically expressed otherwise. The alloy of the present invention preferably comprises in weight percentages the following constituents: 38-55% Ni, 12-25% Cr, 0.5-5% Mo, 0-3% Cu, 2-4.5% Nb, 0.5-3% Ti, 0-0.7% Al, 0.005-0.04% C, balance Fe plus incidental impurities and deoxidizers. The Fe content of the alloy is between about 16-35%.

The annealing and age hardening conditions used in connection with the alloy of the invention are as follows. Annealing is done in the temperature range of 1750° F. to 2050° F. (954° C. to 1121° C.). The aging is preferably accomplished in a two-step procedure. The upper temperature is in the range of 1275° F. to 1400° F. (690° C. to 760° C.) and the lower temperature is in the range of 1050° F. to 1250° F. (565° C. to 677° C.). Single temperature aging at either temperature range is also possible but markedly extends the aging time and can result in slightly less strength and/or ductility as well as generally raising the cost of the heat treatment.

BRIEF DESCRIPTION OF THE DRAWINGS

FIG. 1 is a photograph of a diffraction pattern using a transmission electron microscopy (TEM) instrument of alloy #1 heat treated using the B procedure showing the alloy matrix and γ' phase spots; and FIG. 2 is a photograph of a diffraction pattern using a TEM instrument of alloy #7 heat treated according to procedure C showing the alloy matrix as well as γ' and γ" phase spots.

DETAILED DESCRIPTION OF THE INVENTION

As stated above, the chemical compositions set forth herein are in weight percentages. In accordance with the present invention, the alloy contains about 38-55% Ni, 12-25% Cr, 0.5-5% Mo, 0-3% Cu, 2.0-4.5% Nb, 0.5-3% Ti, 0-0.7% Al, 0.005-0.04% C, balance Fe plus incidental impurities and deoxidizers. Ni modifies the Fe-based matrix to provide stable austenitic structure, which is essential for good thermal stability and formability.

Nickel (Ni) is one of the main elements, which forms $Ni_3Al$-type γ' phase, which is essential for high strength. Further, a minimum of about 35% Ni is required to have good aqueous stress corrosion resistance. Rather high Ni content increases metal cost. The Ni range is broadly defined as 35-55% and, more preferably, the Ni content is 38-53%.

Chromium (Cr) is essential for corrosion resistance. A minimum of about 12% Cr is needed for aggressive corrosive environment, but higher than 25% Cr tends to result in the formation of alpha-Cr and sigma phases, which are detrimental for mechanical properties. The broad Cr range is defined as 12-25% and, more preferably, the Cr content is 16-23%.

Molybdenum (Mo) is present in the alloy. An addition of Mo is known to increase pitting corrosion resistance. The addition of Mo also increases the strength of Ni—Fe alloys by substitution solid solution strengthening since the atomic radius of Mo is much larger than Ni and Fe. However, higher than about 8% Mo tends to form unwanted $Mo_7(Ni,Fe,Cr)_6$-type μ-phase or ternary σ-phase (sigma) with Ni, Fe and Cr. These phases degrade workability. Also, being expensive, higher Mo contents unnecessarily increase the cost of the alloy. The Mo range is broadly defined as 0.5-5% and, more preferably, the Mo content is 1.0-4.8%.

Copper (Cu) improves corrosion resistance in non-oxidizing corrosive environments. The synergistic effect of Cu and Mo is recognized for countering corrosion in typical oil patch applications where there are reducing acidic environments containing high levels of chlorides. The Cu range is broadly defined as 0-3% and, more preferably, the Cu content is 0.2-3%.

Aluminum (Al) additions result in the formation of $Ni_3(Al)$-type γ'-phase which contributes to high strength. A certain minimum content of Al is required to trigger the formation of γ'. Further, the strength of an alloy is proportional to the volume fraction of γ'. Rather high volume fractions of γ', however, result in degradation in hot workability. The aluminum range is broadly defined as 0-0.7% and, more preferably, the Al content is 0.01-0.7%.

Titanium (Ti) incorporates into $Ni_3(Al)$ to form a $Ni_3(AlTi)$-type γ' phase, which increases the volume fraction of γ' phase and, hence, the strength of the alloy. The strengthening potency of γ' is also enhanced by the lattice mismatch between γ' and the matrix. Titanium does tend to increase the lattice spacing of γ'. Synergistic increase in Ti and decrease in Al is known to increase the strength by increasing lattice mismatch. Ti and Al contents have been optimized herein to maximize lattice mismatch. Another important benefit of Ti is that it ties up N present as TiN. Lowering the N content in the matrix improves the hot workability of the alloy. Exceedingly large amounts of Ti leads to precipitation of unwanted $N_3Ti$-type η phase, which degrades hot workability and ductility. The broad titanium range is 0.5-3% and, more preferably, the Ti content is 0.6-2.8%.

Niobium (Nb) reacts with $Ni_3(AlTi)$ to form a $Ni_3(AlTiNb)$-type γ' phase, which increases the volume fraction of γ' phase and, hence, the strength. It was discovered that a particular combination of Nb, Ti, Al and C results in the formation of γ' and γ" phases, which increases the strength dramatically. The ratio of (Nb−7.75 C)/(Al+Ti) is in the range of 0.5 to 9 to obtain the desired high strength. Further, the alloy must have a minimum of 1 wt. % γ" as a strengthening phase. In addition to this strengthening effect, Nb ties up C as NbC, thus decreasing the C content in the matrix. The carbide forming ability of Nb is higher than that of Mo and Cr. Consequently, Mo and Cr are retained in the matrix in the elemental form, which is essential for corrosion resistance. Further, Mo and Cr carbides have a tendency to form at the grain boundaries, whereas NbC is formed throughout the structure. Elimination/minimization of Mo and Cr carbides improves ductility. An exceedingly high content of Nb tends to form unwanted σ-phase and excessive amounts of NbC and γ", which are detrimental for processability and ductility. The niobium range is broadly 2.1-4.5% and, more preferably, the Nb content is 2.2-4.3%.

Iron (Fe) is an element which constitutes the substantial balance in the disclosed alloy. Rather high Fe content in this system tends to decrease thermal stability and corrosion resistance. It is recommended that Fe not exceed 35%. Broadly, the Fe content is 16-35%, more preferably between 18-32% and still more preferably between 20-32%. Additionally, the alloy contains incidental amounts of Co, Mn, Si, Ca, Mg, and Ta. Hereafter, the disclosure includes example alloys to further illustrate the invention.

Table 1 shows chemical compositions of the different alloys evaluated. Alloys 1-5 have compositions containing Nb below the range of the invention. Table 2 shows annealing and age hardening conditions. Mechanical properties determined after annealing and age hardening are listed in Tables 3 and 4. Comparison of properties shows that yield strengths listed in Table 3 are in the range of 107 to 116 ksi for alloys 1-5 and yield strengths listed in Table 4 are in the range of 125 to 145 ksi for alloys 6-10 of the present invention.

TABLE 1

Chemical Compositions of the Alloys (% by weight)

| Alloy # | Fe | Ni | Cr | Mo | Cu | C | Al | Nb | Ti |
|---|---|---|---|---|---|---|---|---|---|
| 1 | 28.2 | 42.9 | 20.5 | 3.4 | 2.2 | 0.010 | 0.2 | 0.3 | 2.3 |
| 2 | 27.4 | 42.9 | 20.4 | 3.4 | 1.6 | 0.021 | 0.5 | 1.0 | 2.5 |
| 3 | 23.7 | 47.0 | 20.5 | 3.3 | 2.0 | 0.009 | 0.2 | 1.0 | 2.3 |
| 4 | 23.4 | 47.0 | 20.4 | 3.3 | 2.0 | 0.008 | 0.5 | 1.0 | 2.4 |
| 5 | 20.9 | 48.8 | 20.5 | 3.3 | 2.1 | 0.008 | 1.0 | 1.0 | 2.4 |
| 6 | 25.7 | 43.8 | 20.4 | 3.4 | 1.9 | 0.017 | 0.4 | 2.9 | 1.4 |
| 7 | 25.2 | 44.2 | 19.5 | 3.4 | 2.0 | 0.006 | 0.3 | 3.8 | 1.6 |
| 8 | 25.4 | 43.8 | 20.5 | 3.5 | 2.0 | 0.002 | 0.4 | 3.2 | 1.2 |
| 9 | 25.2 | 43.7 | 20.5 | 3.5 | 2.1 | 0.003 | 0.4 | 3.7 | 0.9 |
| 10 | 27.0 | 42.9 | 20.0 | 3.3 | 2.0 | 0.012 | 0.2 | 3.0 | 1.5 |

Note:
Alloys 1, 2, and 6-9 were VIM melted, and alloys 3-5 and 10 were VIM + VAR melted.
VIM stands for vacuum induction melting and VAR stands for vacuum arc remelted.

TABLE 2

Heat Treatments

| Heat Treatment | Initial Heating (Anneal) | Reheating (Aging) |
|---|---|---|
| A | 1875° F./1 h, WQ | 1350° F./8 h, FC to 1150° F./8 h, AC |
| B | 1875° F./1 h, WQ | 1365° F./8 h, FC to 1150° F./8 h, AC |
| C | 1900° F./h, WQ | 1350° F./8 h, FC to 1150° F./8 h, AC |
| D | 1900° F./h, WQ | 1365° F./8 h, FC to 1150° F./8 h, AC |
| E | 1925° F./1 h, WQ | 1350° F./10 h, FC to 1150° F./8 h, AC |
| F | 2025° F./1 h, WQ | 1325° F./8 h, FC to 1150° F./8 h, AC |

WQ = water quench,
FC = Furnace cool at 100° F./hour,
AC = Air cool

TABLE 3

Room temperature mechanical properties. Impact and hardness are the averages of three test data. Numbers 1 and 2 are 50 pound VIM alloys and 3 to 5 are 135 pound VIM + VAR heats.

| Alloy # | Heat Treatment | YS, ksi 0.2% | UTS, ksi | Elongation, % | ROA, % | Impact strength, ft-lbs | Hardness, Rc |
|---|---|---|---|---|---|---|---|
| 1 | B | 110.8 | 167.8 | 24.1 | 31.1 | 24.3 | 33.8 |
| | | 111.1 | 168.1 | 24.4 | 30.1 | | |
| 2 | B | 111.4 | 175.1 | 23.6 | 25.3 | 23.0 | 38.6 |
| | | 109.3 | 165.6 | 21.3 | 28.7 | | |
| 3 | B | 113.8 | 175.0 | 25.7 | 34.0 | 31 | 36.4 |
| | | 116.3 | 175.5 | 25.3 | 33.5 | | |
| 4 | B | 112.7 | 178.3 | 26.6 | 37.2 | 40.7 | 36.9 |
| | | 114.3 | 179.2 | 26.0 | 39.9 | | |
| 5 | B | 110.1 | 180.1 | 26.5 | 34.5 | 39.0 | 38.3 |
| | | 107.5 | 179.0 | 25.9 | 31.8 | | |

YS = 0.2% yield strength,
UTS = ultimate tensile strength,
ROA = reduction of area

TABLE 4

Room temperature mechanical properties. Impact and hardness are the averages of three test data. Numbers 6 to 9 were 50 lb. VIM alloys and 10 was 135 lb. VIM + VAR alloys.
Room Temperature Mechanical Properties

| Alloy # | Heat Treatment | YS, ksi 0.2% | UTS, ksi | Elongation, % | ROA, % | Impact strength, ft-lbs | Hardness, Rc |
|---|---|---|---|---|---|---|---|
| 6 | A | 126.7 | 172.0 | 27.6 | 41.1 | 38.0 | 37.5 |
| | | 125.4 | 172.4 | 27.6 | 39.8 | | |
| 7 | F | 143.5 | 179.4 | 21.2 | 28.0 | 33 | 36.2 |
| | | 142.9 | 178.2 | 21.4 | 28.6 | | |
| | | 144.8 | 180.2 | 20.4 | 25.7 | | |
| 8 | E | 127.2 | 169.1 | 25.4 | 31.2 | 48.3 | 36.7 |
| | | 132.9 | 173.2 | 25.6 | 28.6 | | |
| 9 | F | 136.7 | 170.5 | 23.6 | 31.5 | 47.3 | 38.0 |
| | | 135.1 | 169.2 | 24.9 | 35.7 | | |
| 10 | A | 139.4 | 179.4 | 24.2 | 37.9 | 31.7 | 37.6 |
| | | 135.9 | 178.1 | 24.5 | 37.4 | | |
| 10 | C | 136.2 | 177.7 | 24.0 | 31.6 | 40 | 39.7 |
| | | 136.8 | 176.8 | 24.4 | 32.4 | | |
| 10 | D | 134.5 | 176.5 | 22.1 | 28.8 | 29.3 | 39.5 |
| | | 138.4 | 176.0 | 28.8 | 28.8 | | |

YS = 0.2% yield strength,
UTS = ultimate tensile strength,
ROA = reduction of area Table 5 shows ratios of (Nb−7.75 C)/(Al+Ti), average yield strength, and calculated wt. % of percentages of γ' and γ". Calculations were done using a ThermoCalc® based software. It is surprising to note that only the alloys of (Nb−7.75 C)/(Al+Ti) ratio of higher than 0.5 have yield strength of higher than 120 ksi. Further, only these alloys (6-10) were predicted to have the presence of strengthening phase γ". Experimental analysis on low yield strength (alloy #1) and high yield strength (alloy #7) material confirmed the absence and presence of γ", see FIGS. 1 and 2. The additional streaks seen in FIG. 2 are generated by the presence of γ" precipitates. Corrosion testing showed that the alloy #10 having (Nb−7.75 C)/(Al+Ti) ratio of 1.76 and an average yield strength of 136.5 ksi also had good corrosion resistance in oil patch type applications, see Table 6.

TABLE 5

Ratios of weight percentage of hardening elements, average measured 0.2% yield strength, and calculated amount of strengthening phases as determined by ThermoCalc.

| Alloy # | (Nb − 7.75C)/(Al + Ti) | Yield strength, ksi | Weight % γ' | Weight % γ" |
|---|---|---|---|---|
| 1 | 0.12 | 111.0 | 11.3 | 0 |
| 2 | 0.33 | 110.4 | 14.2 | 0 |
| 3 | 0.40 | 115.0 | 13.0 | 0 |
| 4 | 0.34 | 113.5 | 16.1 | 0 |
| 5 | 0.29 | 108.8 | 16.7 | 0 |
| 6 | 1.6 | 126.0 | 12.2 | 2.6 |
| 7 | 2.00 | 143.7 | 11.5 | 6.5 |
| 8 | 2.00 | 130.0 | 10.5 | 4.4 |
| 9 | 2.84 | 135.9 | 8.1 | 6.6 |
| 10 | 1.76 | 136.5 | 9.6 | 4.6 |

Alloy samples annealed and aged as given in Tables 2-4.

TABLE 6

Slow strain rate corrosion test results. Testing was done at 300° F. in deaerated 25% NaCl under 400 psig $CO_2$ and 400 psig $H_2S$. Time-to-failure (TTF), % elongation (EL), and % reduction-of-area (RA) and their ratios in environment/air are listed below. This was alloy #10 with C heat treatment.

| | TTF, | | | Environment/Air Ratios | | | Average Ratios | | |
|---|---|---|---|---|---|---|---|---|---|
| Test history | hours | % EL | % RA | TTF | % EL | % RA | TTF | % EL | % RA |
| Air | 18 | 25.9 | 36.8 | | | | | | |
| Environment | 15.3 | 22.0 | 29.4 | 0.85 | 0.85 | 0.80 | 0.85 | 0.85 | 0.79 |
| Environment | 15.7 | 22.6 | 27.5 | 0.87 | 0.87 | 0.75 | | | |
| Environment | 15.1 | 21.7 | 29.7 | 0.84 | 0.84 | 0.81 | | | |

It will be noted in Table 5 that alloys 1-5 did not satisfy the formula:

$$\frac{(Nb - 7.75\ C)}{(Al + Ti)} = 0.5 - 9$$

and, thus, did not achieve the desired minimum yield strength of 120 ksi. Alloys 1-5 had average yield strengths between 109-115 ksi. On the other hand, alloys 6-10 according to the present invention are seen in Table 5 as having calculated values which did satisfy the above formula and achieved average yield strengths of between 126-144 ksi. When the calculated value of the above formula falls between the desired range of 0.5-9 according to the present invention, a minimum of 1 wt. % γ" phase is present in the alloy matrix, along with the γ' phase, and a total weight % of γ'+γ" phases between about 10 to 30% is present, which accounts for the enhanced yield strength in excess of the 120 ksi minimum desired. It will be noted in Table 5 that alloys 1-5 which did not satisfy the above formula contained no γ" phase, while alloys 6-10 of the present invention contained 2.6-6.6 wt. % γ" phase along with 8.1-12.2% γ' phase in the matrix. The alloy of the present invention preferably contains 1-10 wt. % γ" phase. The sum of the γ'+γ" wt. % is between 10 and 30 and preferably between 12 and 25.

Alloy 10 of the present invention was prepared and subjected to slow strain rate corrosion testing. The testing was conducted at a temperature of 300° F. in deaerated 25% NaCl under 400 psig $CO_2$ and 400 psig $H_2S$. A comparative test was also conducted on alloy 10 in an air environment. The results of the testing are set forth in Table 6, above. It will be seen that alloy 10 in the harsh environment exhibited a time-to-failure (TTF) ratio of about 0.85 that of alloy 10 in air with a similar % elongation ratio (EL). The % reduction in area (RA) ratio was 0.79. These data indicate that the alloys of the present invention provide excellent corrosion resistant properties and meet suggested industry standards when subjected to a very strong sour gas well environment.

Hence, according to the present invention, the Ni—Fe—Cr alloy system is modified with additions of Mo and Cu to improve corrosion resistance. Additionally, Nb, Ti, Al and C additions are optimized to produce a fine dispersion of γ' and γ" phases in the matrix to provide for high strength. As such, the present invention provides a ductile, high strength, high impact strength, and corrosion resistant alloy primarily intended for the manufacture of bars, tubing and like shapes for gas and/or oil well applications.

Table 7 below provides the presently preferred ranges of elements that make up the alloy of the invention along with a presently preferred nominal composition.

TABLE 7

| | Chemical Composition (% By Weight) | | | |
|---|---|---|---|---|
| | Broad | Intermediate | Narrow | Nominal |
| Ni | 35-55 | 38-53 | 38-52 | 43 |
| Cr | 12-25 | 16-23 | 18-23 | 20 |
| Mo | 0.5-5 | 1.0-4.8 | 1.0-4.5 | 3.0 |
| Cu | 0-3 | 0.2-3 | 0.5-3 | 2 |
| Nb | 2.1-4.5 | 2.2-4.3 | 2.5-4 | 3.5 |
| Ti | 0.5-3 | 0.6-2.8 | 0.7-2.5 | 1.5 |
| Al | 0-0.7 | 0.01-0.7 | 0.05-0.7 | 0.2 |
| C | 0.005-0.04 | 0.005-0.03 | 0.005-0.025 | 0.01 |
| Fe | Bal.* | Bal.* | Bal.* | Bal.* |
| (Nb − (7.75C)/ (Al + Ti) | 0.5-9 | 0.5-8 | 0.5-6 | 2.01 |

*plus incidental impurities and deoxidizers

In addition to meeting the compositional ranges set forth above in Table 7, the alloy of the invention must satisfy the equation:

$$\frac{(Nb - 7.75\ C)}{(Al + Ti)} = 0.5 - 9$$

to ensure that the alloy matrix contains a mixture of γ' and γ" phases with a minimum of 1% by weight γ" phase and a total wt. percent of γ' and γ" of between 10 and 30 present for strengthening purposes.

Although air melting is satisfactory, the alloy of the present invention is preferably prepared using a VIM practice or a VIM+VAR melting practice to ensure cleanliness of the ingot. The final heat treating method of the present invention comprises a first solution anneal by heating at between 1750° F. (954° C.) to 2050° F. (1121° C.) for a time of about 0.5 to 4.5 hours, preferably 1 hour, followed by a water quench or air cooling. The product is then aged preferably by heating to a temperature of at least about 1275° F. (691° C.) and held at temperature for a time of between about 6-10 hours to precipitate γ' and γ" phases, optionally by a second aging heat treatment at about 1050° F. (565° C.) to 1250° F. (677° C.) and held at that temperature to conduct a secondary aging step for about 4 to 12 hours, preferably for a time of about 8 hours. The material after aging is allowed to air cool to ambient temperature to achieve the desired microstructure and maximize the γ' and γ" strengthening. After heat treating in this manner, the desired microstructure consists of a matrix plus γ' and a minimum of 1% γ". Broadly, the total wt. percent of γ'+γ" is between 10 and 30 and preferably between 12 and 25.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A process for manufacturing a high strength corrosion resistant alloy comprising the steps of:

providing an alloy consisting essentially of, in percent by weight: 35-55% Ni, 12-25% Cr, 0.5-5% Mo, 0.2-3% Cu, 2.2-4.5% Nb, 0.5-3% Ti, up to 0.7% Al, 0.005-0.04% C, 16-35% Fe, plus incidental impurities and deoxidizers and wherein the alloy satisfies the equation:

$$\frac{(Nb - 7.75\ C)}{(Al + Ti)} = 0.5 \text{ to } 9$$

and heat treating the alloy by annealing, water quenching and at least one age hardening step, whereby the alloy contains a mixture of γ' and γ" phases with a minimum of 1% by weight γ" phase and has a minimum yield strength of 120 ksi when said alloy is in the annealed, water quenched, and age hardened condition and suited for use in sour gas and oil well environments.

2. The process of claim 1 including two age hardening steps.

3. The process of claim 1 wherein the annealing step is conducted at 1750° F. (954° C.) to 2050° F. (1121° C.) and the age hardening is in two aging steps conducted at 1275° F. (691° C.) to 1400° F. (760° C.) and 1050° F. (565° C.) to 1250° F. (677° C.).

4. The process of claim 3 wherein the first aging step is followed by a furnace cool to the second aging temperature, followed by air cooling.

5. The process of claim 1 wherein the alloy contains a total weight % of γ' and γ" phases of 10 to 30.

6. The process of claim 1 including the step of shaping the alloy in the form of a tube or bar for use in a gas or oil well environment or marine environment.

* * * * *